United States Patent [19]

Iwata et al.

[11] 4,197,486

[45] Apr. 8, 1980

[54] CONTROL SYSTEM FOR DEFLECTING AN ELECTRON BEAM

[75] Inventors: Atsushi Iwata, Tokorozawa; Minpei Fujinami; Akinori Shibayama, both of Tokyo; Norio Yokozawa, Fuchu; Kenji Maio, Tokyo; Kenji Fujikata, Hachioji, all of Japan

[73] Assignees: Nippon Telegraph and Telephone Public Corporation; Hitachi, Ltd., both of Japan

[21] Appl. No.: 842,155

[22] Filed: Oct. 14, 1977

[30] Foreign Application Priority Data

Oct. 14, 1976 [JP] Japan ..... 51-123166

[51] Int. Cl.[2] ..... H01J 29/70; H01J 29/72

[52] U.S. Cl. ..... 315/367; 315/365; 315/395

[58] Field of Search ..... 315/365, 367, 391, 395; 340/324 A

[56] References Cited

U.S. PATENT DOCUMENTS

| | | | |
|---|---|---|---|
| 3,937,879 | 2/1976 | Jensen | 315/395 X |
| 4,019,090 | 4/1977 | Wolff et al. | 315/391 X |

*Primary Examiner*—Theodore M. Blum

*Attorney, Agent, or Firm*—Craig and Antonelli

[57] ABSTRACT

An electron beam deflection control system includes a first signal generation circuit which generates a triangular signal varying at a comparatively low speed, a second signal generation circuit which generates a stepped signal varying at a comparatively high speed, and a switching arrangement to change over the first and second signal generation circuits and to drive one of them, whereby the signal from the generation circuit selected by the switching arrangement is used as a deflection signal for an electron beam.

8 Claims, 8 Drawing Figures

(a)

(b)

CONTROL SYSTEM FOR DEFLECTING AN ELECTRON BEAM

BACKGROUND OF THE INVENTION

This invention relates to an electron beam deflection control system which is suitable for use in an electron beam exposure system, a graphic display system, and the like.

An electron beam exposure system functions to form a minute pattern of a semiconductor device or circuit on a mask or a semiconductor wafer with an electron beam. In order to draw the necessary pattern with the electron beam, the system employs an electron beam deflection control circuit which deflects the electron beam linearly at a uniform speed and which, upon completion of the drawing of one pattern, cuts off the electron beam and moves it to the starting point of the next pattern. The electron beam deflection control system of this type has been provided as a digital system and an analog system in the prior art.

In one prior art electron beam deflection control system of the digital type, coordinate data corresponding to respective points of a line pattern are sequentially generated in accordance with data fed from a digital computer, they are converted into an analog signal having a stepped shape by a digital-to-analog converter, and the electron beam is deflected stepwise. With such prior art system, however, the settling time of the digital-to-analog converter which determines each step width of the stepped signal is long. Disadvantageously, therefore, as the line pattern becomes longer, the drawing time becomes longer.

On the other hand, in an electron beam deflection control system of the analog type, a closed loop circuit consisting of a differential amplifier having a limiter function and an integrator is provided, start point and end point levels of a drawing pattern generated by a digital-to-analog converter are sequentially impressed on the closed loop circuit, and the outputs of the integrator are converged to the end point level, thereby to produce a triangular deflection signal. With such an analog system, however, the outputs of the integrator becomes dull in the vicinity of the start and end points of the drawing patern, and therefore, degrade the precision of the drawing pattern. Besides, the convergence time of the first-order lag system formed by the differential amplifier and the integrator increases as a dead time. Therefore, in the case where the drawing pattern is short, the dead time becomes significant as compared with the drawing time. Since the triangular deflection signal is used also for the movement of the beam between the patterns, the dead time increases still more.

SUMMARY OF THE INVENTION

An object of this invention is to provide an electron beam deflection control system which makes it possible to execute a drawing at a very high speed.

Another object of this invention is to provide an electron beam deflection control system which enhances the precision of a drawing pattern.

In order to accomplish such objects, this invention consists in changing over and operating an analog system which generates a triangular deflection signal varying at a comparatively low speed and a digital system which generates a stepped deflection signal varying at a comparatively high speed.

More specifically, according to this invention the digital and analog systems are changed over by taking notice of the fact that, in the digital system, the length of a pattern to be drawn and the drawing speed are in perfect proportional relation, yet the gradient of a proportional curve is great by reason of the setting time of the digital-to-analog converter described previously; while, in the analog system, the length of a drawing pattern and the drawing speed are in a proportional relation in the form in which a shift of the dead time described earlier is involved, yet the gradient of a proportional curve is small. Thus, while the drawing pattern is short, the digital system has a relatively short drawing time; whereas, when the drawing pattern becomes long, the analog system has a relatively short drawing time. By way of example, a long pattern is drawn by the analog system, and the drawing of a short pattern or the beam movement between patterns is carried out by the digital system.

DETAILED DESCRIPTION OF THE PRIOR ART

Figure 1:
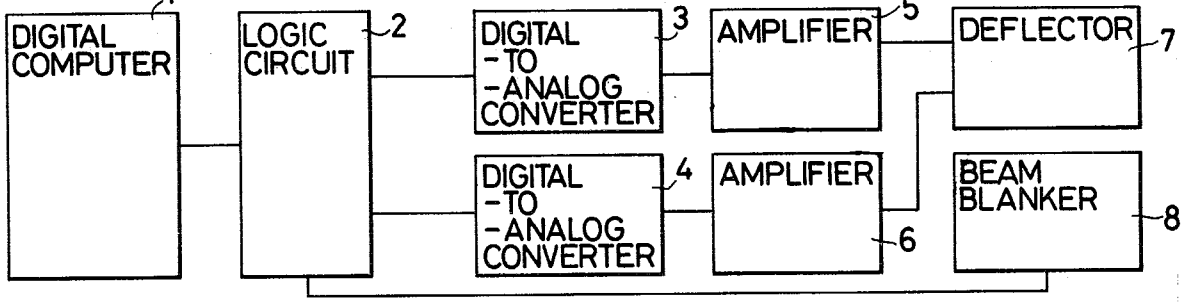
FIG. 1 PRIOR ART
FIG. 1 is a block diagram of a prior art charged beam deflection control system of the digital type.

FIG. 1 shows the block arrangement of a prior art beam deflection control system of the digital type. Numeral 1 designates a digital computer, numeral 2 a logic circuit for producing a control signal, numerals 3 and 4 digital-to-analog converters, numerals 5 and 6 amplifiers for amplifying deflection signals, numeral 7 a deflector, and numeral 8 a beam blanker.

In operation, coordinate data corresponding to respective points of a pattern are sequentially produced by the logic circuit 2 in accordance with data fed from the digital computer 1. The resultant data is converted into analog signals (voltages or currents) by the digital-to-analog converters 3 and 4. Here, the converter 3 and the amplifier 5 form the x-direction channel, and the converter 4 and the amplifier 6 form the y-direction channel. Since the analog signals are in a stepped shape, a beam is deflected stepwise. In this system, the time at which the step is advanced is controlled by a signal of a clock generator contained within the logic circuit 2. A beam blanking signal can be digitally generated by the logic circuit 2. In the case where the movement of the beam is carried out in the beam blanking state, the digital-to-analog converter 3 or 4 is controlled by the logic circuit 2 so that the beam may arrive at a target point in one block.

In case of this system, the precision of the drawing pattern is excellent. On the other hand, however, the system has a disadvantage as stated below. The width of each step of the stepped signal is determined by the settling time of the digital-to-analog converter. In general, the settling time is long; therefore, as the drawing pattern becomes longer, the drawing time becomes longer proportionally. The system of this type is accordingly very inconvenient for drawing a long pattern.

Figure 2:
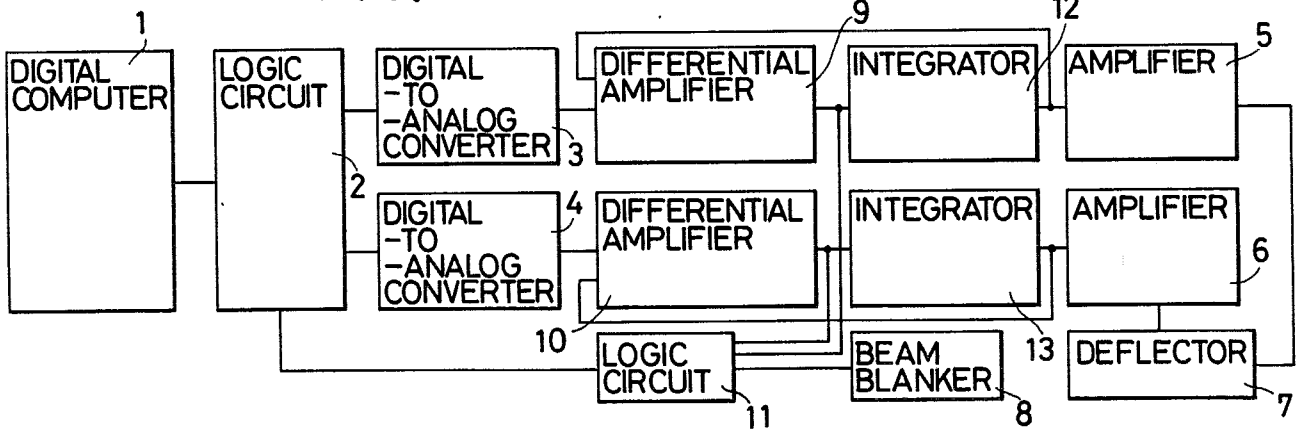
FIG. 2 PRIOR ART
FIG. 2 is a block diagram of a prior art charged beam deflection control system of the analog type.

FIG. 2 shows a block diagram of a prior art beam deflection control system of the analog type. Elements 1 through 8 are the same as those components designated by corresponding symbols in FIG. 1. Numerals 9 and 10 indicate differential amplifiers with voltage limiters, numeral 11 a logic circuit for beam blanking signal generation and containing a voltage comparator therein, and numerals 12 and 13 integrators.

In operation, when the x-directional deflection is considered, an analog signal level corresponding to the starting point of line drawing is generated by the digital-to-analog converter 3. Subsequently, an analog signal level corresponding to the end point of the line drawing is generated by the converter 3. Then, owing to the closed loop formed by the differential amplifier 9 and the integrator 12, when the difference between the output of the converter 3 and an output of the integrator 12 is great and an output of the differential amplifier 9 is limited, the output of the integrator 12 varies at a fixed rate. At this time, a line is drawn while providing a beam ON signal at an output of the logic circuit 11 under the control of the logic circuit 2. When the output of the integrator 12 has come to the output of the converter 3, the output of the differential amplifier 9 enters a linear region, and the first order lag circuit composed of the differential amplifier 9 and the integrator 12 converges to a point at which the output of the converter 3 and that of the differential amplifier 9 coincide. At this time, the output of the differential amplifier 9 becomes zero. It is detected by the voltage comparator contained in the logic circuit 11, and a beam OFF signal is provided at the output of the logic circuit 11 so as to blank the beam. This process is repeated, and the scanning and drawing is done by triangular waves. The y-directional deflection is similarly executed by the converter 4, the operational amplifier 10 and the integrator 13.

The disadvantages of this system are that the output of the integrator 12 becomes dull in the vicinities of the start and end points of the line to degrade the quality of the drawing pattern, and that the convergence time of the first order lag system constituted of the differential amplifier 9 and the integrator 12 increases as a dead time. Especially, when the length of the drawing line becomes less than about 10 $\mu$m, the dead time becomes significant in comparison with the drawing time. Besides, it leads to an increase of the dead time to carry out the beam movement under the beam blanking state by the use of the triangular wave signal.

DETAILED DESCRIPTION OF PREFERRED EMBODIMENTS

Figure 3:
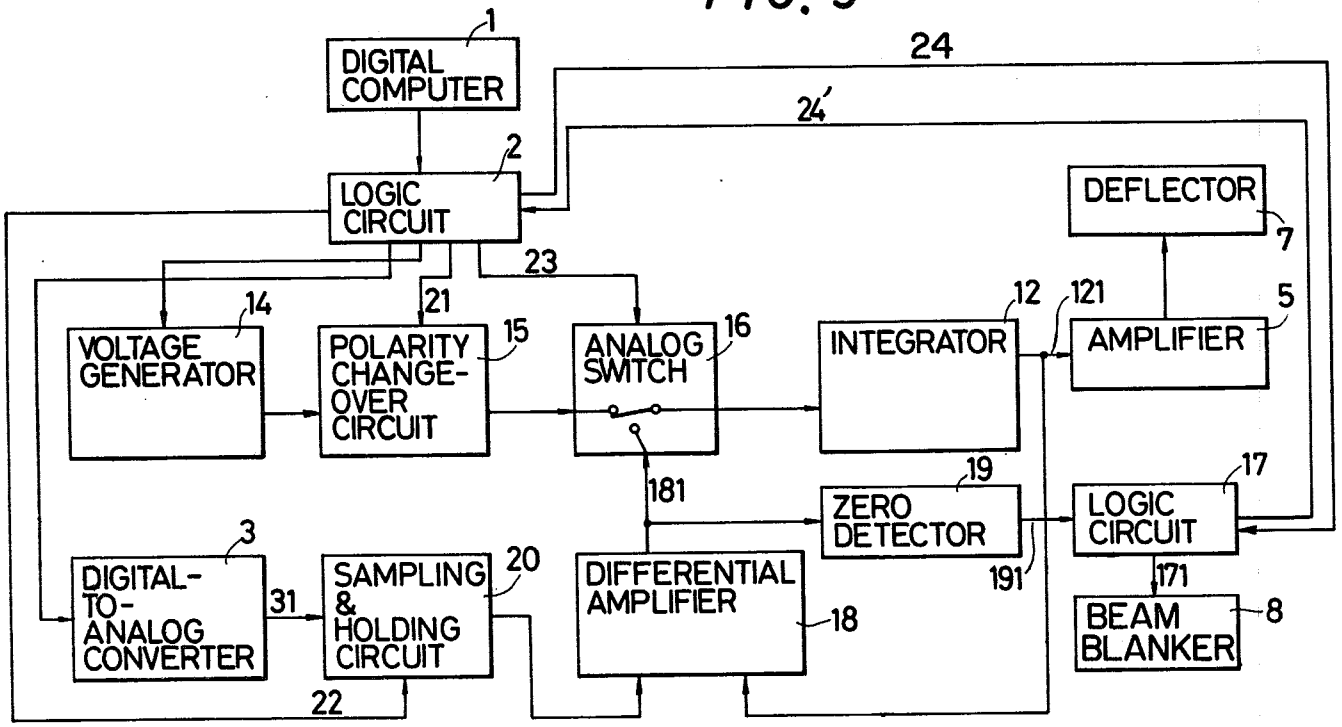
FIGS. 3 and 3*a* are block diagrams which show a first embodiment of a charged beam deflection control system according to this invention.

FIG. 3 shows an embodiment of an electron beam deflection control system according to this invention. Elements 1, 2, 3, 5, 7, 8, and 12 correspond to those components identified by the same symbols in FIGS. 1 and 2.

Numeral 14 designates a voltage generator for determining the line speed, numeral 15 a polarity change-over circuit for changing over the polarity of the output from the voltage generator 14, numeral 16 an analog switch, numeral 17 a logic circuit for beam blanking signal generation, numeral 18 a differential amplifier, numeral 19 a zero detector, and numeral 20 a sample and hold circuit. Except for the digital computer 1, logic circuit 2, and beam blanker 8, the components corresponding to one axis (x-axis or y-axis) are illustrated in FIG. 3. The same construction applies to the other axis.

The operation of this system will now be explained. First of all, in the case of drawing a comparatively long line using the analog system, an analog output signal 31 corresponding to the starting point of the line is generated by the converter 3 in response to the digital computer 1 and the logic circuit 2. The sample and hold circuit 20 is set at a sampling mode in advance, and the output signal 31 is applied to a first input terminal of the differential amplifier 18. Since an output signal 121 from the integrator 12 is applied to a second input terminal of the differential amplifier 18, an output 181 from the differential amplifier 18 represents gain times and voltage difference between the output signals 31 and 121. When a control signal 23 is given beforehand so as to throw the analog switch 16 to the side of the differential amplifier 18, then the analog switch 16, the integrator 12 and the differential amplifier 18 form a first order lag closed loop. Therefore, the circuitry operates so as to bring the output signals 121 and 31 into coincidence, and the starting point of the line is set.

Figure 4:
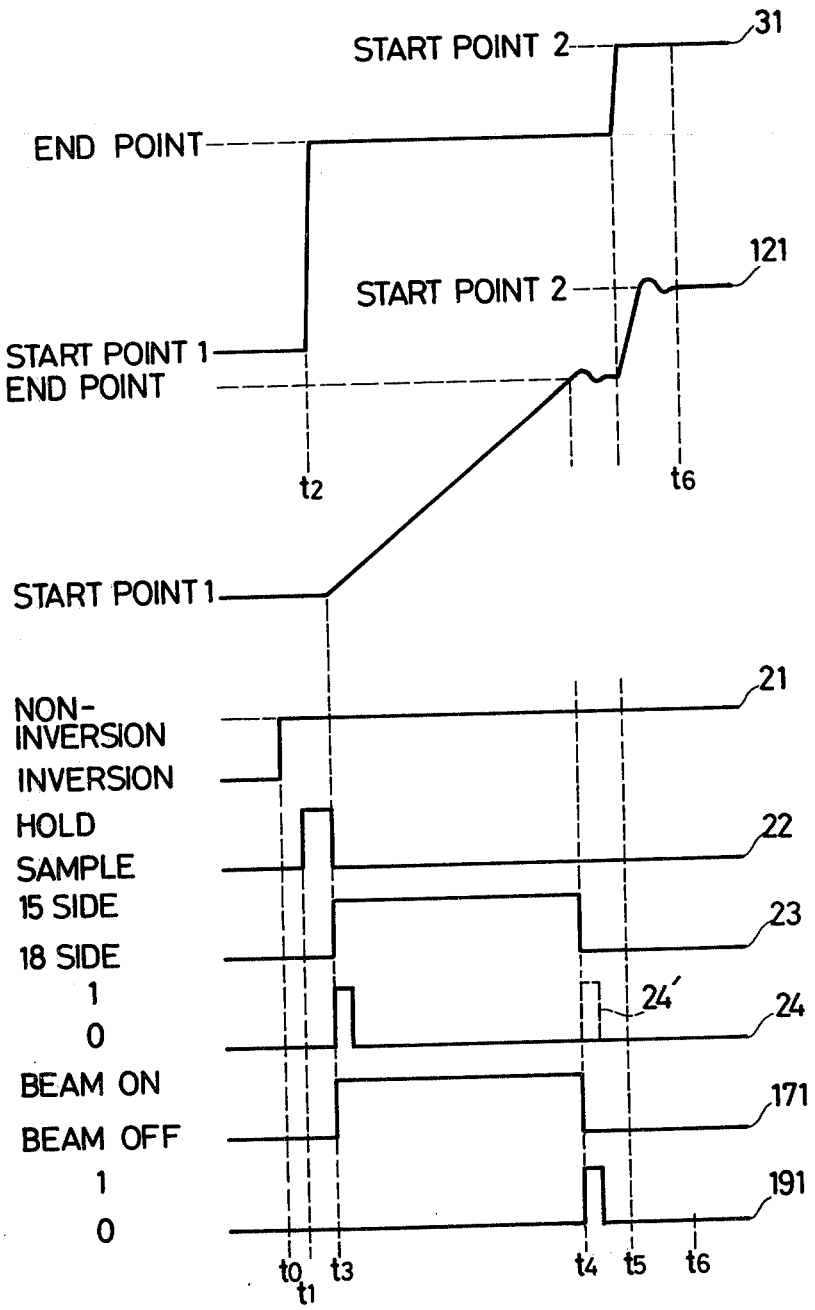
FIG. 4 is an operating time chart of the embodiment of FIG. 3 operating as an analog system.

The subsequent operation will be explained in conjunction with an operating time chart in FIG. 4. At a time $t_0$, data representing the end point of the line is compared with data representing the starting point of the line and the decision concerning the relative magnitudes of these signals is made by means of the logic circuit 2. A signal 21 for controlling the polarity of the polarity change-over circuit 15 is generated by logic circuit 2 so as to direct the output signal 121 towards the end point, with the result that the polarity of the polarity change-over circuit 15 is set to non-inversion or inversion. At a time $t_1$, the sample and hold circuit 20 is put into a holding mode by a control signal 22 from the logic circuit 2. At a time $t_2$ slightly later than $t_1$, the data representing the end point of the line is applied to the converter 3, and an output signal 31 of an analog voltage corresponding to the end point is generated. At a time $t_3$ slightly after the time $t_2$, the analog switch 16 is changed over from the side of the differential amplifier 18 to the side of the polarity change-over circuit 15 by a control signal 23 from the logic circuit 2. Then, the integrating operation of the integrator 12 is initiated in conformity with the line speed set by the voltage generator 14 and the polarity set by the polarity change-over circuit 15, and the output signal 121 varies linearly versus time. Simultaneously therewith, the logic circuit 17 is rendered operative by a control signal 24, and an output signal 171 in the form of a beam blanking signal is switched to the beam ON state, to start the drawing operation.

At the time $t_3$, the sample and hold circuit 20 is changed over from the holding mode to the sampling mode by the control signal 22 from the logic circuit 2, and the output signal 31 is applied to the differential amplifier 18. When, at a time $t_4$, the output signal 121 coincides with the output signal 31, the output 181 becomes zero, the zero detector 19 becomes operative, and an output signal 191 rises. The AND operation between the output signal 191 and the ON state of the signal 171 is taken, and the output signal 171 being the beam blanking signal is switched to the beam OFF state by the logic circuit 17, so that the drawing operation is stopped. Simultaneously, a control signal 24' from the logic circuit 17 is applied to the logic circuit 2, the analog switch 16 is changed over to the side of the differential amplifier 18 by the control signal 23, and a closed loop consisting of the analog switch 16, the integrator 12 and the differential amplifier 18 is established so as to bring the output signal 121 to the same level as that of the output signal 31.

As will be described in detail later, the output signal 121 is brought to the next start point level at a time $t_5$ and returns to a steady state at $t_6$. The output signal 121 is amplified by the deflector 7, to deflect the beam. By repeating this process, the pattern can be drawn as a set of lines. In this manner, the triangular wave signal is used for drawing the long line, whereby a higher speed than in the digital system is achieved.

Secondly, there will be explained a case of performing the beam movement between patterns by the digital system. It is supposed that, at the time $t_5$ in FIG. 4, the drawing of the first pattern is completed, and the beam is shifted to the second pattern. At this time, the sample and hold circuit 20 remains in the sampling mode, to provide the converter 3 with data of the starting point of the second pattern and to generate an output signal 31 of an analog voltage corresponding thereto. In this case, the analog switch 16 is kept on the side of the differential amplifier 18, and the closed loop consisting of the analog switch 16, the integrator 12 and the differential amplifier 18 is established to bring the output signal 121 into coincidence with the output signal 31 at the time $t_6$. At this time, the time in which the output signal 121 follows up the output signal 31 is determined by (integration time-constant of the integrator 12)/(gain of the differential amplifier 18), and the drawing speed is rendered high. Meanwhile, the logic circuit 17 is inhibited by a control signal 24 so as not to operate, and the output signal 171 remains "off."

Now, description will be made of a case of drawing a short line by the digital system. The sample and hold circuit 20 is set at the sampling mode by a control signal 22, while the analog switch 16 is connected to the side of the differential amplifier 18 by a control signal 23. Accordingly, the output signal 121 follows up the output signal 31 with high speed.

Figure 5:
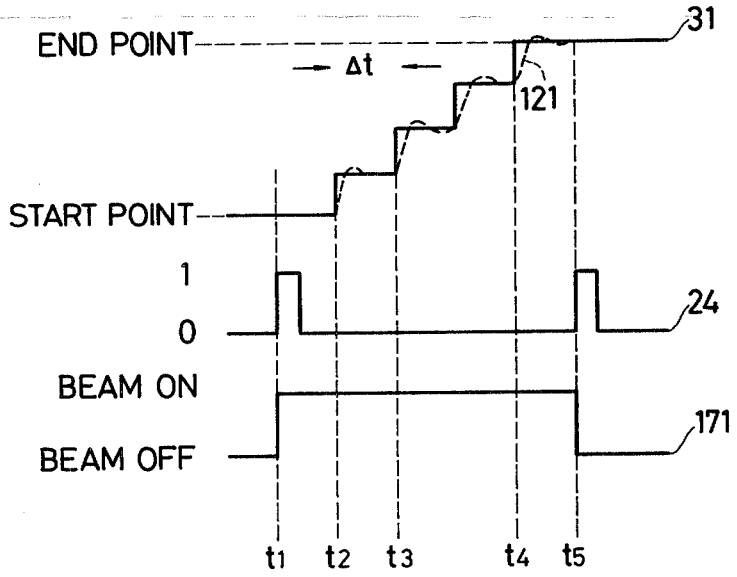
FIG. 5 is an operating time chart of the embodiment of FIG. 3 operating as a digital system.

FIG. 5 shows a time chart of such a case. Digital data corresponding to the starting point of the line is fed from the digital computer 1 through the logical circuit 2 to the converter 3. At a time $t_1$, an output signal 31 is settled to a level corresponding to the starting point. The output signal 171 of the logic circuit 17 is switched to the beam ON state by a control signal 24, and the drawing of a first dot is initiated. At a time $t_2$, the clock generator and counter contained in the logic circuit 2 are started, data corresponding to a second dot is fed from the logic circuit 2 to the converter 3, and the output signal 31 of the converter 3 is shifted and settled to a level corresponding to the position of the second dot. At a time $t_3$, the output signal 31 is similarly shifted and settled to a level corresponding to the position of a third dot. In this case, $\Delta t = t_2 - t_1 = t_3 - t_2$ needs to be greater than the settling time of the digital-to-analog converter, and the interval between the first and second dots needs to be smaller than the diameter of the dot. By this process, the line is drawn as a row of dots. When the dot reaches the end point of the line at a time $t_4$, the output signal 171 of the logic circuit 17 is switched to the beam OFF state by a control signal 24 at a time $t_5 = t_4 + \Delta t$, and the line drawing is completed.

Whether the digital system or the analog system is to be used may be determined by operating the logic circuits contained in the block 2 in conformity with the data fed from the digital computer 1 and thus controlling the control signals 22, 23, and 24 as well as the input signal of the digital-to-analog converter 3.

Figure 3A:
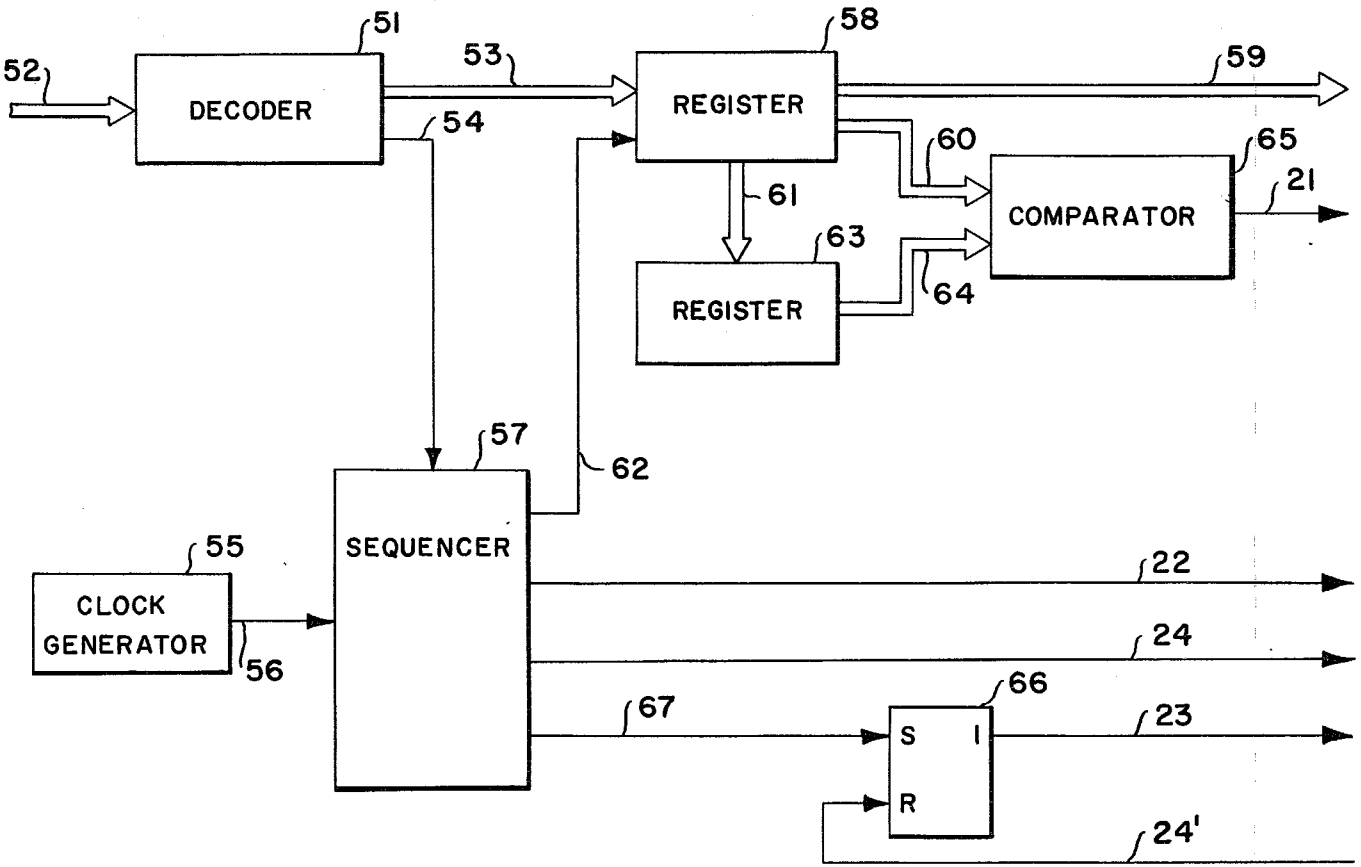

FIG. 3*a* illustrates one embodiment of concrete construction of the logical circuit 2 shown in FIG. 3.

In FIG. 3*a*, numeral 51 designates a decoder for converting the digital data 52 from the digital computer 1 into coordinate data 53 corresponding to respective points of a pattern and a mode signal 54 illustrative of an analog system or digital system, numeral 55 a clock generator for generating clock signals 56, numeral 57 a sequencer with counters for sequencially generating various control signals in response to the clock signal 56, numeral 58 a target point register for storing the coordinate data and for outputting these data as signals 59, 60 and 61 in response to control signals 62 from the sequencer 57, numeral 63 a start point register for storing the signal 61 and for outputting a start point signal 64, numeral 65 a comparator for comparing the signal 60 representing the end point of the line pattern with the signal 64 representing the start point thereof and for generating a signal 21 for controlling the polarity of the polarity change-over circuit 15 in response to the relative magnitude of these signals 60 and 64, numeral 66 a flip-flop circuit which is set and reset by means of a control signal 67 from the sequencer 57 and the signal 24' from the logical circuit 17, respectively, and outputs a set signal as the control signal 23. The control signals 22 and 24 are generated from the sequencer 57. The signal 59 from the register 58 are delivered to the digital-to-analog converter 3.

Figure 6:
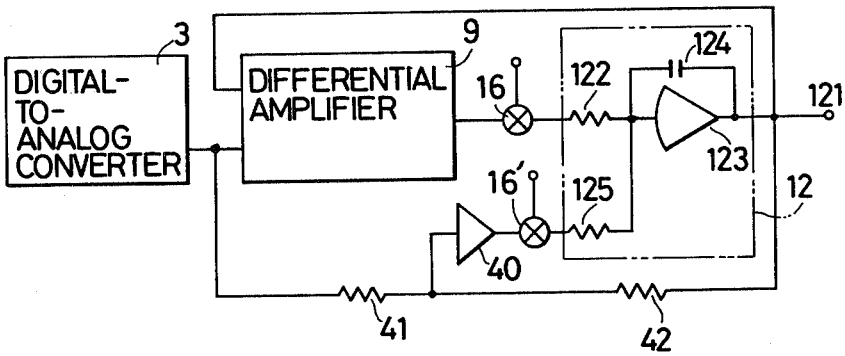
FIGS. 6(*a*) and 6(*b*) are a block diagram and a characteristic diagram, respectively, which illustrate a second embodiment of the charged beam deflection control system according to this invention.
Figure 6:
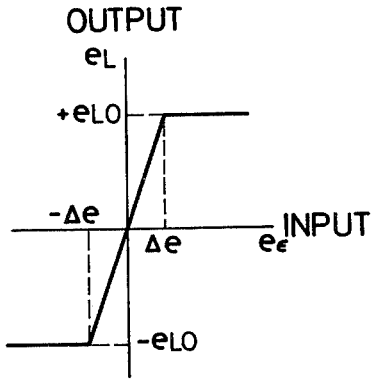

FIGS. 6(*a*) and 6(*b*) show another embodiment of the electron beam deflection control system according to this invention. FIG. 6(*a*) shows the principal portions of a deflection signal generator circuit for the X-axis or Y-axis. For the sake of convenience in the description, the illustrated circuit will hereunder be deemed the circuit for the X-axis. First, an analog switch 16 is switched to the ON state. Then, a difference $e_{68}$ between an output signal 31 from a digital-to-analog converter 3 and an output signal 121 from an integrator 12 is impressed on a differential amplifier 9 having a voltage limiter associated therewith. An output $e_L$ from the differential amplifier 9 is applied via the analog switch 16 to an integration resistor 122 of the integrator 12. It is assumed here that a switch 16' is held in the OFF state. A current of a value obtained by dividing the output $e_L$ of the amplifier 9 by the sum between the internal resistance of the switch 16 and the resistance of the integration resistor 122 flows through the integration resistor 122. Under the action of an operational amplifier 123, it is integrated by an integration capacitor 124 and produces an integrator output signal 121. The input–output characteristic of the differential amplifier 9 is as illustrated in FIG. 6(*b*). This circuit provides a constant value of $e_{LO}$ for $|e_\epsilon| > \Delta e$. As a result, the integration capacitor 124 integrates a fixed current, so that the output current 121 represents a signal which varies at a fixed rate versus time. Since the output signal 121 always varies so as to bring $e_\epsilon$ near to zero, $|e_\epsilon| = \Delta e$ is subsequently established. The differential amplifier 9 conducts a linear operation with further lapse of time, so that $e_L$ decreases and the varying rate of the output signal 121 also decreases. When the output signal 121 has become equal to the absolute value of the output signal 31, $e_\epsilon=0$ holds, that is, the current to be integrated becomes zero, so that the output signal 121 is settled at this value.

Accordingly, by holding the value $\Delta e$ to below a predetermined error at which the limiting characteristic of the differential amplifier 9 begins, the deflection signal is provided with a satisfactory linearity. Although not shown in FIG. 6(*a*), an appropriate voltage comparator may be used for monitoring the output $e_1$ of the differential amplifier 9 so as to control the electron beam intensity upon detection of the state $|e_L|<e_{LO}$. Thus, for example, in an electron beam exposure system, the excessive exposure of the electron beam to a photo resist film or a fluorescent film as attributed to the lowering of the beam deflecting speed at the end point can be effectively avoided. Subsequently, the switch 16 is turned off. This does not change the output signal 121 because the integration current is zero under the present state. Thereafter, the X-coordinate of the next target point is applied to the digital-to-analog converter to slightly shift the Y-axial deflection signal (refer to $\Delta Y$ in FIG. 7). After a period of time sufficient to settle to the output voltage of the digital-to-analog converter, the switch 16 is turned on, whereby the output $e_O$ of the integrator 12 initiates deflection at uniform speed. At this time, accordingly, the electron beam is controlled to the ON state to execute the exposure.

Figure 7:
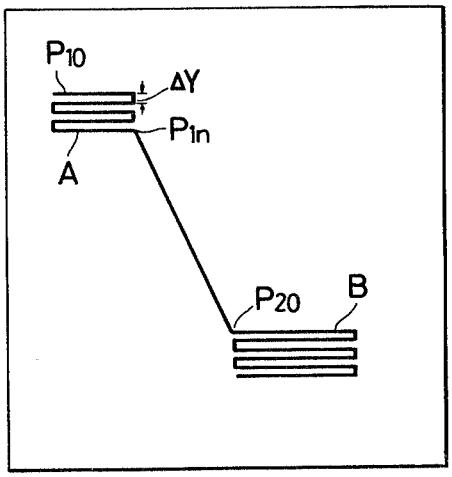
FIG. 7 shows an example of a pattern drawn by the embodiment of FIGS. 6(*a*) and 6(*b*).

By repeating such procedure, smearing exposure as illustrated in FIG. 7 is carried out. Supposing that the exposure of an area A in FIG. 7 has been begun at a point $P_{10}$ and finished at a point $P_{1n}$ by the procedure described thus far, the operation of high-speed deflection to a start point $P_{20}$ for the smearing operation of the next area B will be stated below. When the output signal 121 has been settled at the final point $P_{1n}$ of the area A, the switch 16 is turned off, and the X-coordinate of the point $P_{20}$ is applied to the digital-to-analog converter (the digital-to-analog converter of the Y-axial deflection circuit is endowed with the Y-coordinate of the point $P_{20}$). When the switch 16' is subsequently turned on, the output signals 31 and 121 are added through resistors 41 and 42, respectively, and the sum is amplified by a coefficient multiplier 40. The current obtained by dividing the output voltage of the coefficient multiplier 40 by the sum between the internal resistance of the switch 16' and the resistance of a resistor 125 is integrated by the integration capacitor 124. Here, a path which extends from the input point of the operational amplifier 123 via the operation amplifier 123, resistor 42, coefficient multiplier 40, switch 16', and resistor 125 back to the aforecited input point forms a negative feedback loop. Therefore, the operation after turning the switch 16' "on" is controlled so as to establish $e_O+e_{DA}=0$ (where $e_O$ and $e_{DA}$ denote the output voltages of the integrator 12 and the converter 3, respectively). The settling takes place under the state under which the above equation is fulfilled. The time constant T of the circuit at this high speed deflection operation is given by:

$$T\simeq 2c\cdot r/k$$

on condition that the resistors 41 and 42 have equal resistances. Here, c, r and k represent the capacitance of the integration capacitor, the sum of the resistance of the resistor 125, and the internal resistance of the switch 16', and the coefficient of the coefficient multiplier 40, respectively. As the amplifier of the integrator or the coefficient multiplier 40, an ideal amplifier is assumed. By properly selecting r/k to be a small value, therefore, the output signal 121 can be settled to the target point in a much shorter time than in the foregoing operation of the low speed mode (it is comparatively easy to shorten the settling time to several tenths). After the starting point has been reached in this way, the smearing operation for the area B is executed by the low speed mode employing the switch 16'.

As set forth above, the scanning and drawing in the analog system and the digital system can be easily accomplished by the block arrangements in FIG. 3 and FIG. 6(*a*). Therefore, e.g., by drawing a long pattern with the analog system with high speed and executing the beam movement between lines or between patterns with the digital system with high speed, a high-speed system can be provided. It is also possible to draw a short pattern or a pattern requiring an especially high precision by the use of the digital system.

It is also possible that, while drawing a pattern along the first axis with the analog system, the second axis is moved to draw oblique lines with the digital system by means of the clock generator and the counter which are contained in the logical circuit 2. Further, it is possible to compensate for a deflection distortion or a sample rotation error.

Owing to the system of this invention, there can be realized an electron beam exposure system which skillfully exploits the high drawing speed of the analog system in the case of drawing a long pattern and the high speed and high precision of the digital system in the case of drawing a short pattern and the case of moving a beam between patterns. To be particularly noted is that the system of the invention is not limited by the conversion speed of the digital-to-analog converter. Therefore, the speediness can be achieved with a converter of low speed, and a system of high cost performance can be provided.

What is claimed is:

1. An electron beam deflection control system comprising first signal generation means for generating a triangular wave signal, second signal generation means for generating a stepped wave signal, deflection means to deflect an electron beam, and change-over means to selectively connect either said first or said second signal generation means to said deflection means.

2. An electron beam deflection control system comprising first signal generation means to generate a triangular wave signal varying at a first speed, second signal generation means to generate a stepped wave signal varying at a second speed higher than said first speed, deflection means to deflect an electron beam, and change-over means to selectively connect either said first or second signal generation means to said deflection means.

3. An electron beam deflection control system according to claim 1 wherein said change-over means comprises logic means to connect said first signal generation means to said deflection means when a long line pattern is to be drawn, and to connect said second signal generation means to said deflection means at a time when the electron beam is to be moved between patterns and at a time when a short line pattern is to be drawn.

4. An electron beam deflection control system comprising digital-to-analog conversion means to generate an analog signal corresponding to coordinate data of a pattern to be drawn, differential amplification means receiving an output of said conversion means as one input thereof and having a function of limiting an output thereof, voltage generation means to generate a predetermined voltage, switch means to change over the outputs of said voltage generation means and said differential amplification means, integration means to integrate an output of said switch means and to deliver the integrated output as the other input of said differential amplification means, and deflection means to deflect an electron beam on the basis of the output of said integration means.

5. An electron beam deflection control system according to claim 4, further comprising a computer which generates the coordinate data for said conversion means.

6. An electron beam deflection control system according to claim 4, further comprising detection means to detect that the output of said differential amplification means has become substantially zero, and means to perform blanking of the electron beam in response to such detection by said detection means.

7. An electron beam deflection control system according to claim 4, further comprising means connected between said conversion means and said differential amplification means to sample or hold the output signal of said conversion means.

8. An electron beam deflection control system comprising digital-to-analog conversion means to generate an analog signal corresponding to coordinate data of a pattern to be drawn, differential amplification means receiving an output of said conversion means as one input thereof and having a function of limiting an output thereof, first switch means to conduct or cut off the output of said amplification means, integration means to receive and integrate the conducted output of said switch means and to deliver the integrated output as the other input of said differential amplification means, and second switch means to conduct or cut off a signal to the sum between the outputs of said conversion means and said integration means and to deliver the conducted output to said integration means.

* * * * *